US009716333B1

(12) United States Patent
Hu

(10) Patent No.: US 9,716,333 B1
(45) Date of Patent: Jul. 25, 2017

(54) HEAVY CURRENT FEMALE CONNECTOR

(71) Applicant: Amphenol East Asia Electronic Technology (Shen Zhen) Co., Ltd., Shenzhen (CN)

(72) Inventor: Haixi Hu, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/068,755

(22) Filed: Mar. 14, 2016

(51) Int. Cl.

| | |
|---|---|
| ***H01R 13/115*** | (2006.01) |
| ***H01R 13/53*** | (2006.01) |
| ***H01R 13/436*** | (2006.01) |
| *H01R 12/73* | (2011.01) |

(52) U.S. Cl.
CPC ..... *H01R 13/115* (2013.01); *H01R 13/436* (2013.01); *H01R 13/53* (2013.01); *H01R 12/73* (2013.01); *H01R 12/737* (2013.01)

(58) Field of Classification Search
CPC ..... H01R 12/716; H01R 12/737; H01R 12/73
USPC ..... 439/636, 637
See application file for complete search history.

(56) References Cited

U.S. PATENT DOCUMENTS

| | | | | |
|---|---|---|---|---|
| 3,601,782 | A * | 8/1971 | Gillissen | H01R 12/721 439/636 |
| 6,203,337 | B1 * | 3/2001 | Pei | H05K 7/1007 439/259 |
| 6,336,829 | B2 * | 1/2002 | Matsukawa | H01R 12/57 439/636 |
| 6,764,345 | B1 * | 7/2004 | Duesterhoeft | H01R 12/721 439/637 |
| 8,083,526 | B2 * | 12/2011 | Long | H01R 13/6585 439/60 |

* cited by examiner

*Primary Examiner* — Abdullah Riyami
*Assistant Examiner* — Justin Kratt
(74) *Attorney, Agent, or Firm* — Maier & Maier, PLLC

(57) ABSTRACT

A new fastening heavy current female connector comprising a main body and terminal assemblies. The main body includes separated terminal grooves provided on both of its upper and lower arms and a terminal plugging opening which is a recess in the main body and located between the upper and lower grooves. Each terminal assembly includes two terminals inserted into one of the separated terminal grooves. Each terminal includes a bending portion located between its plugging and non-plugging ends. The new heavy current female connector adds bending portions to the terminals of a common connector. The terminal is bended at its bending portion, enabling it to be elastic and possess a certain degree of tolerability to plugging deflection. Specifically, when the present female connector and a male connector are plugged, stable contacting of electric conductors is ensured.

9 Claims, 2 Drawing Sheets

HEAVY CURRENT FEMALE CONNECTOR

TECHNICAL FIELD

The present application relates to the field of connector, particularly to a new heavy current female connector.

BACKGROUND

Under the circumstance of heavy current, security becomes the premier standard for appraising the quality of connector products. As an important aspect of connector security, the terminals' anti-deflection ability plays a leading role in ensuring the security and durability of connector.

Nowadays, one of the defects of the heavy current connector in prior art is its low adaptability to plugging deflection, i.e. its tolerance to plugging deflection, which may result in bad connection and hence various electrical risks. Furthermore, these connectors are short of plugging convenience and connecting reliability, failing to enhance the connector's security.

SUMMARY

To solve the above mentioned technical problems, the present application provides a new heavy current female connector, which possesses a certain degree of tolerability to plugging deflection and supports hot plugging, greatly enhancing the connector's security and practicability under the circumstance of heavy current conduction.

To be specific, the present application provides a new heavy current female connector comprising a main body and terminal assemblies. The main body includes separated terminal grooves provided on both of its upper and lower arms and a terminal plugging opening which is a recess in the main body and located between the upper and lower arms. Each terminal assembly includes two terminals, each inserted into one of the separated terminal grooves. Each terminal includes a bending portion located between its plugging and non-plugging ends, where the terminal bends.

In a further optimized technical solution, the bending portion is positioned in the middle portion of the terminal.

In a further optimized technical solution, the terminal plugging opening is located in the middle portion of the main body.

In a further optimized technical solution, each terminal includes a lower contacting point specifically located between the bending portions and the non-plugging end.

In a further optimized technical solution, each terminal includes a higher contacting point specifically located between the lowering contacting point and the non-plugging end. Preferably, there are three lower contacting points on each terminal, and at least one lower contacting point will conductively contact the conductive portion of a respective male connector.

In a further optimized technical solution, each terminal includes two side protrusions provided on both sides of the same. When the terminal is inserted into a groove, the side protrusions bear against the inner sides of the groove.

In a further optimized technical solution, the side protrusions are located near the bending portion.

In a further optimized technical solution, each terminal assembly includes an insulation cap fitted at the non-plugging end of the terminal.

In a further optimized technical solution, the insulation cap is fitted to one or two of the terminals of each terminal assembly.

In a further optimized technical solution, the main body includes fastening holes located at two sides of the main body.

Following beneficial effects are achieved by the present application thanks to employment of the above technical solutions. Compared with disclosed technical solutions in the art, the present new heavy current female connector provides a common connector with bending portions added to its terminals. The terminal is bended at its bending portion, making it elastic and therefore possess a certain degree of tolerability to plugging deflection. Specifically, when the present female connector and a male connector are plugged to each other, if the male connector is slantly plugged, the contacting points of the two terminals of the female connector will become inclined as the slant of the male connector so as to guarantee constant spacing of the terminals, thus ensuring stable contacting of the electric conductors.

The terminal plugging opening is configured to symmetrically receive the lower and contacting points, enabling hot plugging of the present female connector. Specifically, there are three lower contacting points on each terminal, and at least one lower contacting point conductively contacts the conductive portion of a respective male terminal.

There are insulation caps assembled at the terminal's non-plugging ends and extending into the separated terminal grooves, which guarantee the correct postures of the terminals as they fit into the main body to avoid pressing between terminals that gives rise to short circuit or deflection in side directions.

When each terminal assembly is inserted into a separated terminal groove, the side protrusions bear against the inner sides of the groove so that the terminal is anchored in the groove, preventing the terminal from extending out of the plugging opening but allowing it to move in the opposite direction.

The main body is provided with fastening holes at its two sides, which cooperate with threaded bolts to strengthen the connection of the male and female connectors.

DETAILED DESCRIPTION

The present application will be set forth in connection with FIGS. 1 to 3 and the specific embodiments, which is in no way intended to limit the present application.

Embodiment 1

Figure 1:
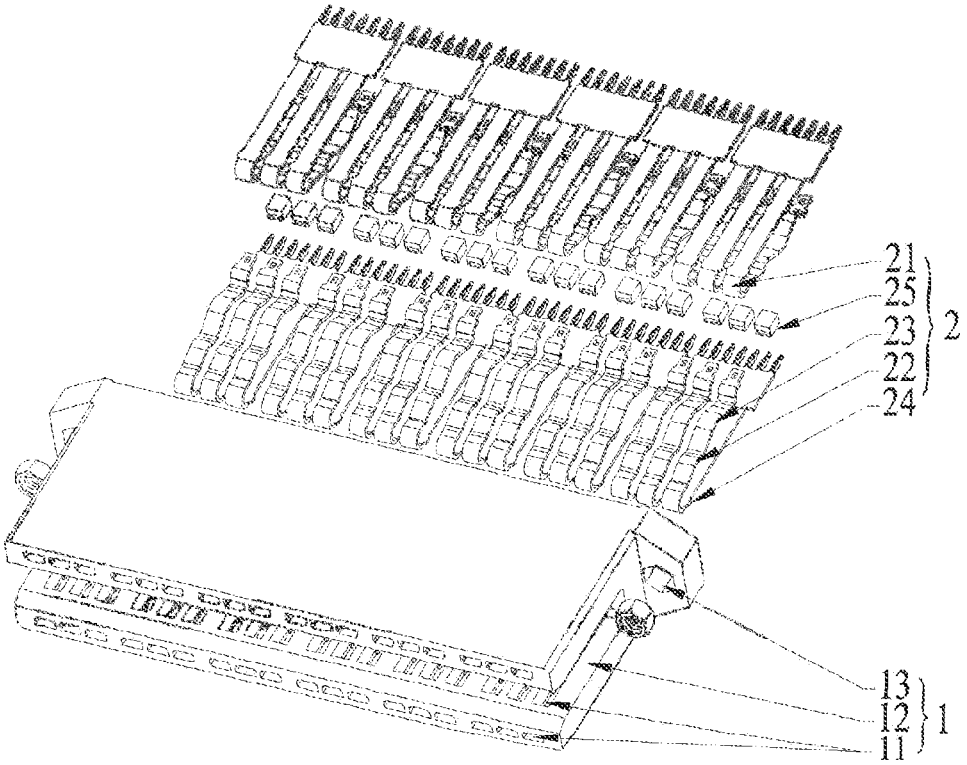
FIG. 1 is an exploded view of a new heavy current female connector.
Figure 3:
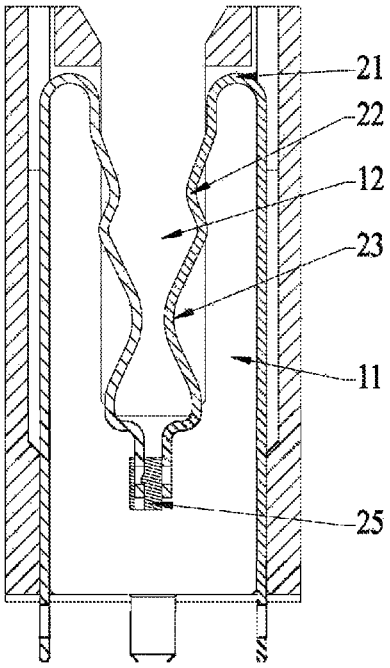
FIG. 3 is a side cross-sectional view of the connector.

As shown in FIGS. 1 and 3, a new heavy current female connector comprises a main body 1 and terminal assemblies 2.

The main body 1 includes separated terminal grooves 11 provided on both of its upper and lower arms, a terminal plugging opening 12 which is a recess in the main body 1 and located between the terminal grooves 11 on the upper and lower arms, and fastening holes 13 located at two sides of the main body 1.

Each terminal assembly 2 includes two terminals each inserted into one of the opposing grooves 11. Each terminal includes a bending portion 21 in its middle region where the terminal bends, a lower contacting point 22 specifically located between the bending portion 21 and the non-plugging end of the terminal, a higher contacting point 23 specifically located between the lower contacting point 22 and the non-plugging end of the terminal, and an insulation cap 25 fitted at the non-plugging end.

Embodiment 2

Figure 2:
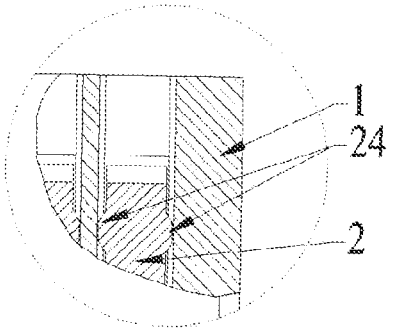
FIG. 2 shows the side protrusions of the connector.

On basis of Embodiment 1, as shown in FIG. 1 and FIG. 2, each terminal includes two side protrusions 24 provided on both sides of it and specifically located near the bending portion 21. When the terminal is inserted into the groove 11, the side protrusions 24 bear against the inner sides of the groove 11.

Embodiment 3

On basis of Embodiment 2, the insulation cap 25 may be assembled to any one or two of the two terminals of each terminal assembly.

It is known from general technical knowledge that the present technical solutions can be achieved by other embodiments which do not depart from the spiritual substance or essential features of the present invention. Therefore, the above mentioned embodiments, in various aspects, are merely illustrative rather than exclusive. All changes within the scope of the present application or the equivalent of the present application are intended to be included within the present application.

What is claimed is:

1. A heavy current female connector comprising:

a main body and terminal assemblies, wherein the main body comprises:

separated terminal grooves provided on both of upper and lower arms of the main body;

a terminal plugging opening which is a recess in the main body and located between the terminal grooves provided on the upper and lower arms;

each terminal assembly includes two terminals being inserted in two opposing terminal grooves, each terminal comprises:

a bending portion provided between two ends of the terminal, where the terminal bends wherein the terminal includes an insulation cap assembled at a non-plugging end of the terminal.

2. The heavy current female connector as set forth in claim 1, wherein the bending portion is positioned in the middle region of the terminal.

3. The heavy current female connector as set forth in claim 2, wherein the terminal plugging opening is located in the middle portion of the main body.

4. The heavy current female connector as set forth in claim 3, wherein each terminal includes a lower contacting point specifically located between the bending portion and the non-plugging end of the terminal.

5. The heavy current female connector as set forth in claim 4, wherein the terminal includes a higher contacting point specifically located between the lower contacting point and the non-plugging end of the terminal.

6. The heavy current female connector as set forth in claim 5, wherein the terminal includes side protrusions provided on both sides of the terminal; when the terminal is inserted into a groove, the side protrusions bear against the inner sides of the groove.

7. The heavy current female connector as set forth in claim 6, wherein the side protrusions are located near the bending portion.

8. The heavy current female connector as set forth in claim 1, wherein the insulation cap is assembled to one or two of the terminals of each terminal assembly.

9. The heavy current female connector as set forth in claim 8, wherein the main body includes fastening holes located at two sides of the main body.

* * * * *